United States Patent [19]

Haas

[11] Patent Number: 5,032,204

[45] Date of Patent: Jul. 16, 1991

[54] INSTALLATION FOR ETCHING OBJECTS

[75] Inventor: Rainer Haas, Herrenberg, Fed. Rep. of Germany

[73] Assignee: Hans Hollmuller Maschinenbau GmbH & Co., Fed. Rep. of Germany

[21] Appl. No.: 543,827

[22] PCT Filed: Nov. 10, 1989

[86] PCT No.: PCT/EP89/01344

§ 371 Date: Jul. 20, 1990

§ 102(e) Date: Jul. 20, 1990

[87] PCT Pub. No.: WO90/05796

PCT Pub. Date: May 31, 1990

[30] Foreign Application Priority Data

Nov. 24, 1988 [DE] Fed. Rep. of Germany ..... 3839626

[51] Int. Cl.[5] ..... B44C 1/22; C23F 1/00

[52] U.S. Cl. ..... 156/345; 156/627; 156/642

[58] Field of Search ..... 156/627, 640, 642, 656, 156/666, 345, 901, 902; 134/103, 105, 198, 199; 204/235, 236, 237, 238, 239, 240, 241

[56] References Cited

U.S. PATENT DOCUMENTS

| | | | |
|---|---|---|---|
| 4,190,481 | 2/1980 | Goffredo | 156/627 X |
| 4,576,677 | 3/1986 | Faul et al. | 156/642 |
| 4,741,798 | 5/1988 | Haas | 156/642 X |
| 4,772,365 | 9/1988 | Haas | 156/642 X |

FOREIGN PATENT DOCUMENTS

| | | |
|---|---|---|
| 0222347 | 5/1987 | European Pat. Off. . |
| 0222348 | 5/1987 | European Pat. Off. . |
| 3305319 | 8/1984 | Fed. Rep. of Germany . |
| 3632021 | 3/1988 | Fed. Rep. of Germany . |

*Primary Examiner*—William A. Powell
*Attorney, Agent, or Firm*—Fred Philpitt

[57] ABSTRACT

An installation for etching objects comprises at least one etching machine, in which metal is etched from the objects treated, the etching medium being enriched with metal. The etching medium is regenerated in at least one electrolytic cell by removing metal. Two buffer tanks are located in the lines which connect the etching machine to the electrolytic cell. A first control circuit ensures a substantially constant density of the etching medium in the etching machine. This takes place by the supply of depleted etching medium from the first buffer tank to the etching machine and by the removal of enriched etching medium from the etching machine into the second buffer tank. A second control circuit ensures a substantially constant density in the electrolytic cell by the supply of enriched etching medium from the second buffer tank into the electrolytic cell and by the removal of a corresponding quantity of depleted etching medium from the electrolytic cell into the first buffer tank. Both control circuits operate independently of each other.

9 Claims, 1 Drawing Sheet

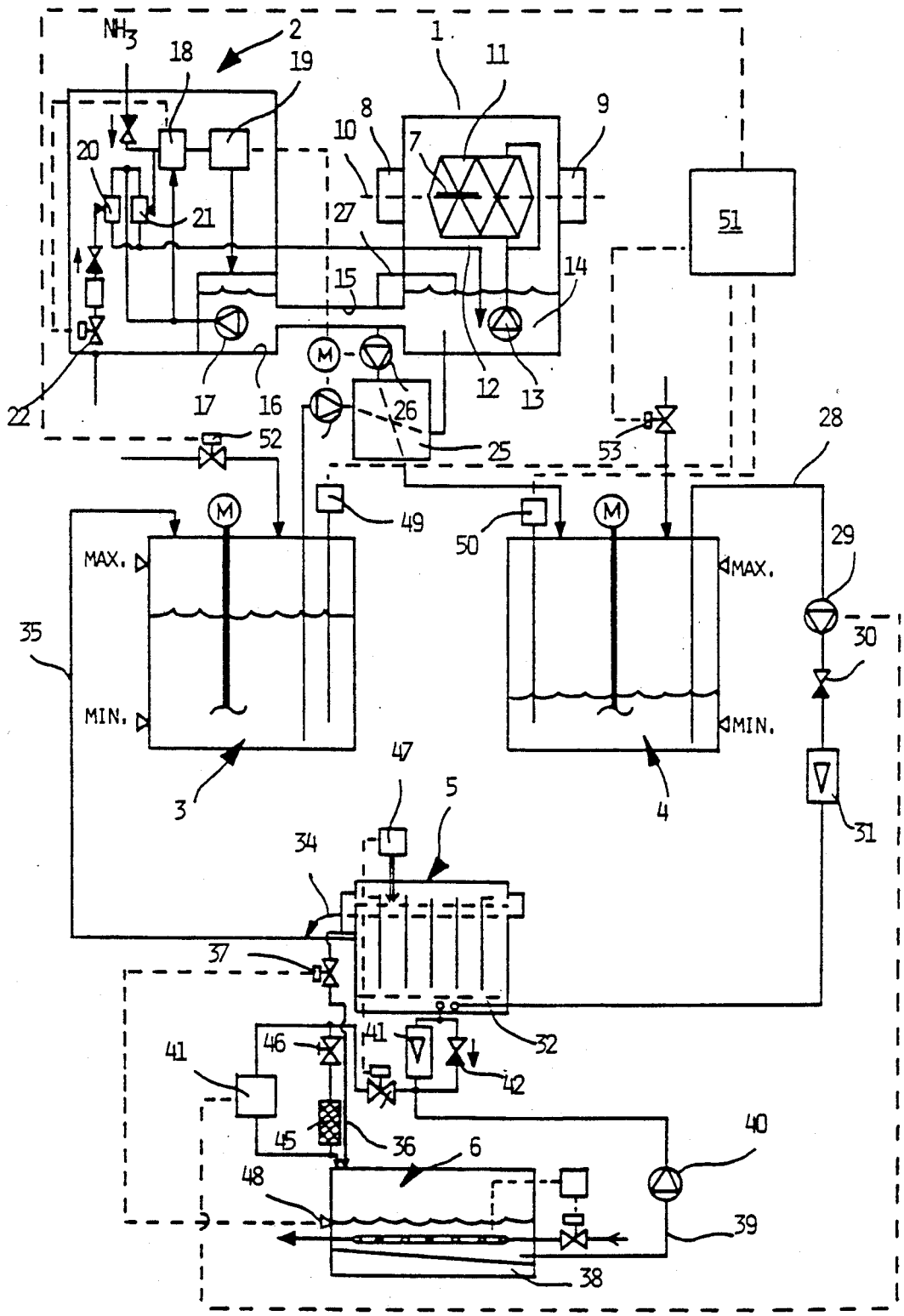
NH3
2
18
19
1
11
8
9
10
7
20
21
27
51
15
14
22
17
16
26
12
13
52
25
53
28
49
50
29
MAX.
MAX.
35
30
MIN.
MIN.
47
3
4
5
31
34
37
32
41
46
41
42
45
36
6
40
48
39
38

INSTALLATION FOR ETCHING OBJECTS

The invention relates to an installation for etching objects, in particular printed circuit boards, with a) at least one etching machine, in which metal is etched from the objects, the etching medium being enriched with metal;

b) at least one electrolytic cell, in which enriched etching medium is depleted;

c) at least one electronic control circuit, which controls the exchange of etching medium between the etching machine and the electrolytic cell so that the density of the etching medium in the etching machine is substantially constant.

In known etching installations of this type, only a single control circuit is provided, which attempts to keep the density of the etching medium in the etching machine constant by appropriate operation of the electrolytic cell. This control system operates relatively slowly, so that this may lead to considerable shortages or excesses of the metal concentration in the etching medium located in the etching machine. Moreover this results in a discontinuous operation with frequent starting and stopping of the electrolytic cell, which has an unfavourable influence on the quality of the copper separated. Loosening of the copper layer may also occur, which may lead to short-circuits.

It is the object of the present invention to develop an etching installation of the aforementioned type so that the density of the etching medium in the etching machine as well as of the electrolytic cell can be kept at a constant value with low hysteresis and high accuracy.

An etching installation according to the invention, by which this object is achieved, is characterised by d) a first buffer tank, which is located in the connecting line between the outlet of the electrolytic cell and the inlet of the etching machine;

e) a second buffer tank, which is located in the connecting line between the outlet of the etching machine and the inlet of the electrolytic cell;

f) a first control circuit, which monitors the density of the etching medium in the etching machine and on exceeding a predetermined density value supplies depleted etching medium from the first buffer tank to the etching machine and removes a corresponding quantity of enriched etching medium from the etching machine into the second buffer tank;

g) a second control circuit, which monitors the density of the etching medium in the electrolytic cell and on falling below a predetermined density value supplies enriched etching medium from the second buffer tank to the electrolytic cell and removes a corresponding quantity of depleted etching medium from the electrolytic cell into the first buffer tank, so that the two control circuits are isolated from each other by the buffer tanks and operate independently of each other.

Thus, according to the invention the electrolytic cell operates completely independently of the etching machine. On account of the buffer tanks provided, the quantities of depleted etching medium required for maintaining the correct density can be supplied to the etching machine in a problem-free manner and at any time, independently of whether the electrolytic cell makes or does not make available just depleted etching medium. In a corresponding manner enriched etching medium can be removed from the etching machine independently of whether the electrolytic cell is ready to receive enriched etching medium or not. In turn, the electrolytic cell may operate completely independently of the yield of etching medium to be depleted from the etching machine or of the requirement of the etching machine for depleted etching medium. It is stopped when the second buffer tank is empty. Starting and stopping of the electrolytic cell is required solely at relatively great intervals due to the buffer action of the buffer tanks.

For safety reasons, the electrolytic cell should also be shut down in the case of a second density value, which lies below the above-mentioned density value.

It is appropriate if the electrolytic cell is put out of operation whilst voltage is applied, by switching off the pump, which circulates the etching medium through the electrolytic cell, the contents of the cell flowing into the associated storage tank.

If, as explained in claim 4, the etching medium supplied to the etching machine from the first buffer tank and the etching medium supplied to the second buffer tank from the etching machine are passed through a heat exchanger, energy is saved. The etching medium introduced from the first buffer tank into the etching machine must be brought to the working temperature at that point; the necessary heat can be removed from the etching medium to a considerable extent, which is removed from the etching machine into the second buffer tank.

In this case it is once more an advantage if the opening point of the pipe, by which etching medium is removed from the etching machine, is located at the height of the operating level of the sump of the etching machine, and if the delivery capacity of the pump, which removes etching medium from the etching machine, is slightly above the delivery capacity of the pump, which supplies etching medium to the etching machine. In this way it is automatically ensured, without special additional measures such as level sensors or the like, that the filling height in the pump sump always remains constant. Due to the higher delivery capacity of the discharging pump, the filling height can never rise above the opening point of the removal pipe.

In etching installations of the aforementioned type, but to a greater extent in the design according to the invention, liquid losses occur due to evaporation. The latter must be compensated for. For this purpose, according to one feature of the invention, a water-control unit is provided, which keeps the sum of the filling heights in the various sumps, containers and tanks constant by the addition of fresh water.

As regards switching technology and apparatus, that embodiment is particularly favourable, in which a) the filling heights in the buffer tanks are monitored by level sensors, which are connected to the water control unit;

b) the sum of the filling heights in the buffer tanks is kept constant by the addition of fresh water;

c) the filling heights in the other parts of the installation are kept constant independently of the addition of fresh water.

Generally the above condition c) is fulfilled anyhow by the method of construction of the etching cell (see also the embodiment of the invention according to claim 5). In this case, thus solely the filling heights in the two buffer tanks need to be monitored, to which the corresponding quantity of fresh water is then supplied.

Now in order to avoid that the supply of fresh water to the buffer tanks leads to undesirable dilutions of the etching medium contained therein, the addition of fresh water to each of the buffer tanks advantageously takes place in proportion to the filling heights of these buffer tanks. The fuller buffer tank thus receives a larger quantity of fresh water than the emptier buffer tank, so that the dilution by fresh water in both buffer tanks is approximately the same.

One particular advantage of the use of buffer tanks according to the invention consists in that according to claim 8 the capacity of the electrolytic cell can be less than the capacity of the etching machine. In this case, allowances are made for the fact that generally the daily operating time of the etching machine corresponds to the normal working time during operation (for example 8 hours), whereas the electrolytic cell can be operated without problems around the clock, thus 24 hours a day. The capacity of the buffer tanks must be dimensioned to correspond to the different operating times of the electrolytic cell and of the etching machine.

One embodiment of the invention will be described in detail hereafter with reference to the drawings; the single FIGURE shows diagrammatically an installation for etching objects.

The installation for etching objects illustrated in the drawing comprises as its main components an etching machine 1, a dosing unit 2, a first buffer tank 3, a second buffer tank 4, an electrolytic cell 5 as well as a storage tank 6 for etching medium discharged from the electrolytic cell 5.

The construction of the etching machine 1 is basically known: the objects 7 to be etched are moved by the continuous method from an inlet 8 to an outlet 9 of the etching machine on a roller conveying system 10. They thus pass an upper nozzle assembly 11 as well as a lower nozzle assembly 12, by which they are sprayed with etching medium. The latter is supplied to the nozzle assemblies 11, 12 by a pump 13, which is connected on the suction side to the sump 14 of the etching machine. The etching medium drips from the objects 7 to be etched back into the sump, in which case it changes its chemical composition on account of the etching process and due to evaporation processes.

The dosing unit 2 is provided for monitoring and controlling the chemical composition of the etching medium in the etching machine 1. The sump 14 of the etching machine 1 is connected by way of a connecting line 15 to a container 16 of the dosing unit 2. A pump 17 removes etching medium continuously from the container 16 and conveys the latter in the circuit by way of a ph-meter 18 and a density-measuring device 19 back into the container 16. The delivery side of the pump 17 is also connected to two injectors 20, 21, in which $NH_3$ is mixed with the flowing etching medium. In the left-hand injector 20 in the drawing, $NH_3$ is added to the flowing etching medium, which $NH_3$ originates from a storage tank and its flow is determined by a solenoid valve 22. The solenoid valve 22 is in this case controlled electrically by the ph-meter 18. A minimum ph-value of the etching medium in the etching machine 1 is thus ensured by means of the ph-meter 18 due to the addition of $NH_3$ by way of the solenoid valve 22.

By way of the right-hand injector 21 in the drawing, the gas sucked from the electrolytic cell 5, which contains substantially ammonia, is returned to the etching medium. In this way, the evaporation losses of $NH_3$ are kept small and environmental problems are reduced.

By means of the above-mentioned density-measuring device 19, the density of the etching medium in the etching machine 1, which would rise without special precautions due to the metal etched from the objects 7 (in the case of printed circuit boards generally copper), is kept at a constant value. This takes place in the following manner:

The left-hand buffer tank 3 in the drawing contains a supply of etching medium, which was supplied from the electrolytic cell 5 in a manner to be described further hereafter. On the other hand, the right-hand buffer tank 4 in the drawing contains etching medium of higher density enriched with copper, which is supplied to the electrolytic cell 5 for depletion in a manner likewise to be described hereafter.

A pump 23 is connected on the suction side by way of a line 24 to the buffer tank 3. It conveys the depleted etching medium removed from the buffer tank 3 by way of a heat exchanger 25 into the sump 14 of the etching machine 1. A further pump 26 is connected by way of a line 27 on the suction side to the sump 14 of the etching machine 1. The opening point of the line 27 is located at a height which corresponds to the operating level of the sump 14 in the etching machine 1. The pump 26 passes the etching medium removed from the sump 14 of the etching machine 1 likewise through the heat exchanger 25, where a heat exchange takes place between the etching medium supplied to the sump 14 and the etching medium removed from the sump 14. The etching medium conveyed by the pump 26 then flows from the heat exchanger 25 into the second buffer tank 4, in which, as mentioned above, etching medium enriched with copper is located.

The pumps 23 and 26 are connected to each other electrically or—as illustrated—mechanically by a common motor. The arrangement is such that both pumps 23, 26 are always operated simultaneously, the delivery capacity of the pump 26 always being kept somewhat higher than the delivery capacity of the pump 23. In this way it is ensured that the operating level of the etching medium in the sump 14 of the etching machine 1 is always determined by the opening point of the line 27 into the sump 14.

The right-hand buffer tank 4 in the drawing is connected by way of a line 28 to the suction side of a pump 29, which is connected on the pressure side by way of a non-return valve 30 and a flow meter 31 to the sump 32 of the electrolytic cell 5.

The overflow 33 of the electrolytic cell, from which the depleted etching medium flows, is connected by way of a line 34 to the left-hand first buffer tank 3 in the drawing. A further line 36, in which a solenoid valve 37 is connected, leads from the overflow 34 of the electrolytic cell 5 into the storage tank 6. The sump 38 of the storage tank 6 is connected by way of a line 39 to a pump 40, which supplies the etching medium removed from the sump 38 by way of a flow meter 41, with which a non-return valve 42 is connected in parallel, to the sump 32 of the electrolytic cell 5. The pump 40 is also connected on the delivery side to a solenoid valve 43, which controls the flow path to a density-measuring device 44. The etching medium flowing through the density-measuring device 44 is guided back to the storage tank 6.

Located parallel to the density-measuring device 44 is a hydroxide filter 45, the flow through which can be released as required by means of a valve 46.

The electrolytic cell 5 and storage tank 6 are operated and controlled in the following manner:

At the beginning of operation, the electrolytic cell 5 must be filled with etching medium from the storage tank 6. This takes place by means of the pump 40. When the electrolytic cell 5 has reached its filling level, this is ascertained by a level sensor 47, which opens the solenoid valve 43. Due to this a flow by-pass is released, which reduces the flow of etching medium from the storage tank 6 into the electrolytic cell 5 to the amount necessary for continuous operation. A major part of the etching medium conveyed by the pump 40 now flows through the density-measuring device 44 and through the hydroxide filter 45 back to the storage tank 6.

Normally, the solenoid valve 37 is open. This means that etching medium is circulated by the pump 40 by way of the electrolytic cell 5, its overflow 34 and the solenoid valve 37. However, if etching medium passes from the buffer tank 4 into the sump 32 of the electrolytic cell, the level in the sump 38 of the storage tank rises. A level switch 48 records the rise of the liquid level in the sump 38 and closes the solenoid valve 37. Depleted etching medium now flows through the line 35 into the buffer tank 3.

The density-measuring device 44 monitors the copper content of the etching medium circulated by the pump 40. If this copper content drops below a predetermined value, for example below 30 g/l, the pump 29 is set in operation. On account of the above-described operations, in this case a corresponding quantity of etching medium is removed from the electrolytic cell 5 and supplied to the buffer tank 3. The supply of enriched etching medium from the buffer tank 4 increases the density of the etching medium in the electrolytic cell 5 until the density-measuring device 44 once more stops the pump 29.

The electrolytic cell 5 is put out of operation when the buffer tank 4 is empty. This takes place by switching off the pump 40. The contents of the electrolytic cell thus flow by way of the flow meter 41 and mainly via the non-return valve 42, line 39 and pump 40 back into the storage tank 6. However, the electrolytic cell 5 remains supplied with voltage.

For safety reasons, the electrolytic cell 5 is always shut down when the density of the etching medium contained therein falls below a second value, which lies below the above-mentioned control point.

The entire installation described above obviously contains two control systems, which are isolated from each other by the two buffer tanks 3, 4:

The density-measuring device 19 operating in the first control system ensures a constant density of the etching medium in the etching machine 1. The constant density is brought about by the supply of depleted etching medium from the buffer tank 3 or by the removal of enriched etching medium to the buffer tank 4. On account of the existence of the buffer tanks 3, 4, independent of the respective function of the electrolytic cell 5, depleted etching medium or space for enriched etching medium is always available. The first control system, which contains the density-measuring device 19 as its "core", can also operate completely "autonomously".

The second control system contains the density-measuring device 44 as the controlling unit. It ensures that the density and thus the copper content of the etching medium in the electrolytic cell 5 is kept at a predetermined value. This takes place, as described above, by switching the pump 29 on and off. Once more this control system is completely isolated from the first control system, which contains the etching machine 1, since the electrolytic cell 5 may discharge depleted etching medium into the buffer tank 3 independently of the instantaneous requirement. Likewise, enriched etching medium can be supplied from the buffer tank 4 to the electrolytic cell 5 according to the requirements of the control circuit governing this, irrespective of whether according to the state in the etching machine 1, etching medium just enriched there is available or not.

Due to the aforedescribed isolation of the two control systems, it is possible to regulate and keep constant the density of the etching medium at the actually critical point, namely in the etching machine 1 itself, with greater precision than could be achieved when using solely one control system, which covers both the etching machine 1 as well as the electrolytic cell 5. However, the two buffer tanks 3 and 4 can be used in a further advantageous manner, which will now be described in detail:

In known etching installations, the operating times of the etching machine and of the electrolytic cell 5 used for regeneration of the etching medium are identical daily. If one uses buffer tanks 3 and 4, as described above, then the operating times can be kept different. In this way, a smaller capacity of the electrolytic cell 5 is adequate; it no longer needs to be adapted to the peak requirement of the etching machine 1.

One example:

The etching machine 1 is designed so that it etches away 9 kg Cu per hour, i.e. 72 kg in an 8-hour working day. In order to recover the same quantity of copper in an electrolytic cell 5, which works for 24 hours a day, a capacity of 3 kg Cu/hour is sufficient for the latter. If the depletion in the electrolytic cell amounts to 50 g Cu/1, this means that 1440 l etching medium must be buffered. However, since in the 8 hours of the operating time of the etching machine 1, approximately 480 l are recovered from the electrolytic cell 5, each buffer tank 3, 4 must have a capacity of approximately 1000 l.

The continuous method of operation of the electrolytic cell 5 possible when using the buffer tanks 3, 4 not only reduces the expenditure for apparatus for the entire etching installation; in addition it improves the regeneration operation in the electrolytic cell 5.

During the operation of each etching installation, but particularly when using buffer tanks 3, 4, liquid losses due to evaporation occur. These liquid losses must be compensated for. In the above-described etching installation, this takes place as follows:

The levels in the buffer tanks 3, 4 are monitored continuously by level sensors 49 or 50. The latter are connected to an electronic water-control unit 51. The latter in turn controls a first solenoid valve 52, by way of electrical leads, which are shown in broken line in the drawing, which solenoid valve controls the supply of fresh water to the left-hand buffer tank 3 in the drawing, as well as a second solenoid valve 53, which controls the supply of fresh water to the right-hand buffer tank 4 in the drawing.

Due to the above-described method of operation of the etching machine 1 and of the electrolytic cell 5, it is ensured that a constant filling height is guaranteed therein, without special measures. It is therefore solely necessary for this to ensure that the sum of the levels in the two buffer tanks 3, 4 likewise remains constant. This is the very task of the water-control unit 51. If the latter ascertains a drop of the levels in the buffer tanks 3, 4 in such a way that the sum thereof falls below a reference value, it opens the solenoid valves 52, 53 until the sum of the levels has again reached the desired value. In order to obviate undesired dilutions of the etching medium, which could disturb the operation of the various control circuits, the addition of water to each of the buffer tanks 3, 4 takes place in proportion to the respective level in these tanks. Thus, if for example the level in the left-hand buffer tank 3 in the drawing is twice as high as in the right-hand buffer tank 4 in the drawing, the addition of water by the water-control unit 51 takes place in such a way that twice as much water is supplied to the left-hand buffer tank 3 as to the right-hand buffer tank 4.

I claim:

1. Installation for etching objects, in particular printed circuit boards, with a) at least one etching machine, in which metal is etched from the objects, the etching medium being enriched with metal;

b) at least one electrolytic cell, in which enriched etching medium is depleted;

c) at least one electronic control circuit, which controls the exchange of etching medium between the etching machine and the electrolytic cell so that the density of the etching medium in the etching machine is substantially constant;

characterised by d) a first buffer tank (3), which is located in the connecting line (35) between the outlet of the electrolytic cell (5) and the inlet of the etching machine (1);

e) a second buffer tank (4), which is located in the connecting line (28) between the outlet of the etching machine (1) and the inlet of the electrolytic cell (5);

f) a first control circuit (15, 16, 17, 19, 23, 26), which monitors the density of the etching medium in the etching machine (1) and on exceeding a predetermined density value supplies depleted etching medium from the first buffer tank (3) to the etching machine (1) and removes a corresponding quantity of enriched etching medium from the etching machine (1) into the second buffer tank (4);

g) a second control circuit (40, 43, 44), which monitors the density of the etching medium in the electrolytic cell (5) and on falling below a predetermined density value supplies enriched etching medium from the second buffer tank (4) to the electrolytic cell (5) and removes a corresponding quantity of depleted etching medium from the electrolytic cell (5) into the first buffer tank (3), so that the two control circuits are isolated from each other by the buffer tanks (3, 4) and operate independently of each other.

2. Etching installation according to claim 1, characterised in that on falling below a second density value, which is below the first density value, the electrolytic cell (5) is put out of operation.

3. Etching installation according to claim 1 characterised in that by switching off the pump (40), which circulates the etching medium through the electrolytic cell (5), the electrolytic cell (5) is put out of operation while voltage is applied to the electrodes.

4. Etching installation according to claim 1, characterised in that the etching medium supplied to the etching machine (1) from the first buffer tank (3) and the etching medium supplied to the second buffer tank (4) from the etching machine (1) are passed through a heat exchanger (25).

5. Etching installation according to claim 1, characterised in that the opening point of the line (27), by which the etching medium is removed from the etching machine (1), is located at the height of the operating level of the sump (14) of the etching machine (1) and that the delivery capacity of the pump (26), which removes etching medium from the etching machine (1), is slightly greater than the delivery capacity of the pump (23), which supplies etching medium to the etching machine (1).

6. Etching installation according to claim 1, characterised in that a water control unit (51) is provided, which keeps the sums of the filling heights in the various sumps (14, 32), containers (16, 38) and tanks (3, 4) of the etching installation constant by the addition of fresh water.

7. Etching installation according to claim 6, characterised in that a) the filling heights in the buffer tanks (3, 4) are monitored by level sensors (49, 50), which are connected to the water control unit (51);

b) the sum of the filling heights in the buffer tanks (3, 4) is kept constant by the addition of fresh water;

c) the filling heights in the other parts of the installation are kept constant independently of the addition of fresh water.

8. Etching installation according to claim 7, characterised in that the addition of fresh water to each of the buffer tanks (3, 4) takes place in proportion to the filling heights of these buffer tanks (3, 4).

9. Etching installation according to claim 1, characterised in that the capacity of the electrolytic cell (5) is less than the capacity of the etching machine (1).

* * * * *